US011005156B2

(12) United States Patent
Ying

(10) Patent No.: US 11,005,156 B2
(45) Date of Patent: May 11, 2021

(54) ANTENNA ON PROTRUSION OF MULTI-LAYER CERAMIC-BASED STRUCTURE

(71) Applicant: Sony Mobile Communications Inc., Tokyo (JP)

(72) Inventor: Zhinong Ying, Lund (SE)

(73) Assignee: SONY MOBILE COMMUNICATIONS INC., Tokyo (JP)

( * ) Notice: Subject to any disclaimer, the term of this patent is extended or adjusted under 35 U.S.C. 154(b) by 15 days.

(21) Appl. No.: 16/331,071

(22) PCT Filed: Sep. 15, 2016

(86) PCT No.: PCT/EP2016/071849
§ 371 (c)(1),
(2) Date: Mar. 6, 2019

(87) PCT Pub. No.: WO2018/050230
PCT Pub. Date: Mar. 22, 2018

(65) Prior Publication Data
US 2019/0198974 A1 Jun. 27, 2019

(51) Int. Cl.
*H01Q 1/22* (2006.01)
*H01Q 1/24* (2006.01)
(Continued)

(52) U.S. Cl.
CPC ..... *H01Q 1/2283* (2013.01); *H01Q 1/243* (2013.01); *H01Q 9/0457* (2013.01); *H01Q 9/285* (2013.01);
(Continued)

(58) Field of Classification Search
CPC .... H01Q 1/2283; H01Q 1/243; H01Q 9/0457; H01Q 9/285; H01Q 13/106; H01Q 21/205; H01Q 21/28; H01Q 21/30
See application file for complete search history.

(56) References Cited

U.S. PATENT DOCUMENTS

2005/0134507 A1* 6/2005 Dishongh ..... H01L 23/36 343/700 MS
2009/0295662 A1* 12/2009 Suetsuna ..... H01Q 1/48 343/787
(Continued)

FOREIGN PATENT DOCUMENTS

CN 202977719 U 6/2013
EP 0920071 A2 6/1999
(Continued)

OTHER PUBLICATIONS

International Search Report and Written Opinion from counterpart International Patent Application No. PCT/EP2016/071849 dated Jun. 9, 2017, 10 pages.
(Continued)

*Primary Examiner* — Jimmy T Vu
(74) *Attorney, Agent, or Firm* — Tucker Ellis LLP

(57) ABSTRACT

Antenna on protrusion of multi-layer ceramic-basedstructure An antenna device (100) includes a multi-layer ceramic-basedstructure (110) with a plurality of ceramic-basedlayers. Further, the antenna device (100) includes a protrusion (120) formed by at least one of the ceramic-basedlayers extending beyond at least one other of the ceramic-basedlayers at an edge of the multi-layer ceramic-basedstructure (110). Further, the antenna device (100) includes at least one antenna (140) formed by at least one conductive layer on the protrusion (120).

14 Claims, 6 Drawing Sheets

(51) Int. Cl.

| | |
|---|---|
| ***H01Q 9/04*** | (2006.01) |
| ***H01Q 9/28*** | (2006.01) |
| ***H01Q 13/10*** | (2006.01) |
| ***H01Q 21/20*** | (2006.01) |
| ***H01Q 21/28*** | (2006.01) |
| ***H01Q 21/30*** | (2006.01) |

(52) U.S. Cl.
CPC ..... *H01Q 13/106* (2013.01); *H01Q 21/205* (2013.01); *H01Q 21/28* (2013.01); *H01Q 21/30* (2013.01)

(56) References Cited

U.S. PATENT DOCUMENTS

| | | | | |
|---|---|---|---|---|
| 2010/0114245 | A1 | 5/2010 | Yamamoto | |
| 2010/0164809 | A1* | 7/2010 | Cheng | H01Q 5/378 343/700 MS |
| 2010/0328158 | A1* | 12/2010 | Savolainen | H01Q 1/2283 342/451 |
| 2011/0127337 | A1 | 6/2011 | Ikemoto et al. | |
| 2011/0148716 | A1 | 6/2011 | Sotoma et al. | |
| 2011/0299256 | A1 | 12/2011 | Leiba | |
| 2014/0354513 | A1 | 12/2014 | Nair et al. | |

FOREIGN PATENT DOCUMENTS

| | | | |
|---|---|---|---|
| EP | 1777781 | A1 | 4/2007 |
| JP | 2011114719 | A | 6/2011 |
| KR | 100732113 | B1 | 6/2007 |
| NO | 2014044193 | A1 | 3/2014 |

OTHER PUBLICATIONS

Chinese Office Action with Search Report for corresponding Chinese Patent Application No. 201680089312.1, dated May 29, 2020, 7 pages.

European Office Action from corresponding European Application No. 16766296.4, dated Mar. 11, 2021, 8 pages.

* cited by examiner

ANTENNA ON PROTRUSION OF MULTI-LAYER CERAMIC-BASED STRUCTURE

FIELD OF THE INVENTION

The present invention relates to antenna devices and to assemblies and communication devices equipped with one or more of such antenna devices.

BACKGROUND OF THE INVENTION

In wireless communication technologies, various frequency bands are utilized for conveying communication signals. In order to meet increasing bandwidth demands, also frequency bands in the millimeter wavelength range, corresponding to frequencies in the range of about 10 GHz to about 100 GHz, are considered. For example, frequency bands in the millimeter wavelength range are considered as candidates for 5G (5th Generation) cellular radio technologies. However, an issue which arises with the utilization of such high frequencies is that antenna sizes need to be sufficiently small to match the wavelength. Further, in order to achieve sufficient performance, multiple antennas (e.g., in the form of an antenna array) may be needed in small sized communication devices, such as mobile phones, smartphones, or similar communication devices.

Further, since losses on cables or other wired connections within the communication device typically increase towards higher frequencies, it may also be desirable to have an antenna design in which the antenna can be placed very close to radio front end circuitry.

Accordingly, there is a need for compact size antennas which can be efficiently integrated in a communication device.

SUMMARY OF THE INVENTION

According to an embodiment, a device is provided. The device comprises a multi-layer ceramic-based structure with a plurality of ceramic-based layers. The multi-layer ceramic-based structure may for example be a low temperature co-fired ceramic (LTCC) structure. The ceramic-based layers may correspond to layers formed of one or more ceramic materials or to layers formed of a combination of one or more ceramic materials with one or more other materials, e.g., a combination of a ceramic material and a glass material. Further, the device comprises a protrusion formed by at least one of the ceramic-based layers extending beyond at least one other of the ceramic-based layers at an edge of the multi-layer ceramic-based structure. Further, the device comprises at least one antenna formed by at least one conductive layer on the protrusion. In this way, the antenna can be efficiently formed at an edge of the multi-layer ceramic-based structure. This allows for positioning the antenna close to an outer edge of an apparatus, e.g., close to an outer edge of a communication device. An open space adjacent to the protrusion, can be utilized in an efficient manner for obtaining desired transmission characteristics of the antenna. Specifically, it can be avoided that ceramic-based material adjacent to the antenna, which may have a high dielectric constant of more than 3, e.g., in the range of 3 to 20, typically in the range of 5 to 8, adversely influences the transmission characteristics of the antenna, e.g., by attenuating or distorting radio signals.

According to an embodiment, the at least one antenna is formed by a first conductive layer on one side of the protrusion and a second conductive layer separated by at least one of the ceramic-based layers forming the protrusion. Accordingly, the antenna may be efficiently formed in a multi-layer design. For example, the first conductive layer may comprise an at least one antenna patch and the second conductive layer may comprise at least one feeding patch configured for feeding the at least one antenna patch. The at least one feeding patch may be configured for conductively feeding at least one of the antenna patches. Alternatively or in addition, the at least one feeding patch may be configured for capacitively feeding at least one of the antenna patches. For example, the second conductive layer could include a feeding patch which is conductively coupled to a first antenna patch of the first conductive layer and is further capacitively coupled to a second antenna patch of the first conductive layer. The conductive coupling may be provided by a conductive via extending through the at least one ceramic-based layer forming the protrusion and connecting the first conductive layer and the second conductive layer. It is noted that in some embodiments a conductive via extending through the at least one ceramic-based layer forming the protrusion and connecting the first conductive layer and the second conductive layer may also be provided for other purposes than for conductively feeding an antenna patch, e.g., for forming a three-dimensional antenna structure by combining antenna patches on multiple conductive layers.

According to an embodiment, the at least one antenna comprises a dipole antenna. Alternatively or in addition, the at least one antenna may comprise a notch antenna. However, it is to be noted that other types of antenna configuration could be used as well, e.g., an IFA ("Inverted F Antenna") configuration, a vertical edge patch antenna configuration, and/or an SIW (Substrate Integrated Waveguide) antenna configuration.

According to an embodiment, the device further comprises radio front end circuitry housed in a cavity of the multi-layer ceramic-based structure. The radio front end circuitry may for example include one or more electronic chips. The cavity may be embedded within the multi-layer ceramic-based structure or may be open at a surface of the multi-layer ceramic-based structure. Accordingly, the device may be formed as a package including the radio front and circuitry and the at least one antenna.

According to an embodiment, the antenna is configured for transmission of radio signals having a wavelength of more than 1 mm and less than 3 cm.

According to a further embodiment, an assembly is provided. The assembly comprises at least one device according to any one of the above embodiments. Further, the assembly comprises a circuit board on which the at least one device is arranged, e.g., a printed circuit board (PCB). The at least one device is preferably arranged with the at least one antenna located at an edge of the circuit board. In some embodiments, multiple devices according to any one of the above embodiments may be arranged on the circuit board, preferably along one or more side edges of the circuit board. Also other electronic components may be arranged on the circuit board, e.g., components for generating or processing signals transmitted by the antenna(s) as the device(s) arranged on the circuit board.

According to a further embodiment, a communication device is provided e.g., in the form of a mobile phone, smartphone or similar user device. The communication device comprises at least one device according to any one of the above embodiments. Further, the communication device comprises at least one processor configured to process communication signals transmitted via the at least one antenna of the at least one device. Insert communication device, the antenna(s) of the device(s) may be positioned close to an outer edge of the communication device, which allows for achieving favorable transmission characteristics.

According to an embodiment, the communication device may comprise an assembly as described above. That is to say, the communication device may comprise a circuit board on which the at least one device is arranged. In this case the at least one device is preferably arranged with the at least one antenna located at an edge of the circuit board, allowing to position the antenna close to an outer edge of the communication device. Also the at least one processor of the communication device may be arranged on the circuit board.

The above and further embodiments of the invention will now be described in more detail with reference to the accompanying drawings.

DETAILED DESCRIPTION OF EMBODIMENTS

In the following, exemplary embodiments of the invention will be described in more detail. It has to be understood that the following description is given only for the purpose of illustrating the principles of the invention and is not to be taken in a limiting sense. Rather, the scope of the invention is defined only by the appended claims and is not intended to be limited by the exemplary embodiments described hereinafter.

The illustrated embodiments relate to antenna devices for transmission of radio signals, in particular of short wavelength radio signals in the cm/mm wavelength range. The illustrated antenna devices may for example be utilized in communication devices, such as a mobile phone, smartphone, tablet computer, or the like.

In the illustrated concepts, one or more antennas of the antenna device are provided on a protrusion of a multi-layer ceramic-based structure. In the examples as further detailed below, it is assumed that the multi-layer ceramic-based structure is an LTCC structure. However, it is to be understood that other kinds of multilayer ceramic-based structures could be utilized as well, e.g., based on high-temperature co-fired ceramic (HTCC) or a combination of LTCC and HTCC, or based on a combination of ceramic-based layers with glass and/or polymeric materials. The ceramic-based layers may be formed of one or more ceramic materials or of a combination of one or more ceramic materials with one or more other materials, e.g., a combination of a ceramic material and a glass material. Typically, the ceramic-based layers have a relatively high dielectric constant, e.g., a dielectric constant of more than 3, e.g., in the range of 5 to 8.

The specific technology and materials used to form the multi-layer ceramic-based structure may also be chosen according to achieve desirable dielectric properties for supporting transmission of radio signals of a certain wavelength, e.g., based on the relation $$L = \frac{\lambda}{2\sqrt{\varepsilon_r}}, \tag{1}$$

where L denotes an effective dimension of the antenna, λ denotes the wave-length of the radio signals to be transmitted, and εr denotes the relative permittivity of the substrate material of the multi-layer ceramic-based structure.

Figure 1:
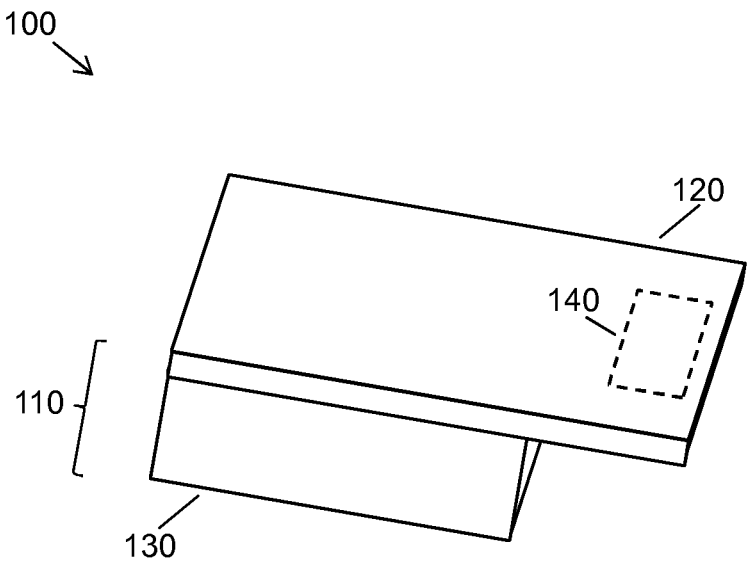
FIG. 1 shows a perspective view schematically illustrating an antenna device according to an embodiment of the invention.

FIG. 1 shows a perspective view illustrating an antenna device 100 which is based on the illustrated concepts. In the illustrated example, the antenna device 100 includes a multi-layer ceramic-based structure 110, e.g., an LTCC structure. The multi-layer ceramic-based structure 110 includes multiple ceramic-based layers which are stacked along a vertical direction. The multi-layer ceramic-based structure 110 is provided with a protrusion 120 formed by one or more of the ceramic-based layers of the multi-layer ceramic-based structure 110. These layers extend beyond one or more other ceramic-based layers of the multi-layer ceramic-based structure 110.

In the illustrated example, the multi-layer ceramic-based structure 110 includes a main body portion 130, and the protrusion 120 extends beyond an edge of the main body portion 130, e.g., by 2 to 5 mm. The protrusion 120 is formed by a top ceramic-based layer or a group of topmost ceramic-based layers stacked upon the main body portion 130. However, it is noted that the ceramic-based layer(s) forming the protrusion 120 could also be arranged at the bottom of the main body portion 130 or correspond to one or more intermediate ceramic-based layers arranged between a bottom part of the main body portion 130 and an upper part of the main body portion 130. The main body portion 130 may include multiple ceramic-based layers, and conductive layers, e.g., metallic layers, may be provided between these multiple ceramic-based layers, e.g., for connecting to electronic circuitry housed within the main body portion 130. Conductive vias, e.g., holes filled with conductive material, such as metal paste, may be formed between different conductive layers of the main body portion 130.

The ceramic-based layers of the multi-layer ceramic-based structure 110 may be prepared individually, e.g., by defining structures of conductive layers on the bottom side and/or top side of the ceramic-based layer and/or one or more conductive vias extending through the ceramic-based layer to connect conductive structures on the top side of the ceramic-based layer to conductive structures on the bottom side of the ceramic-based layer. The ceramic-based layers may then be aligned and connected to each other to form the multi-layer ceramic-based structure 110 and connections between conductive structures on different ceramic-based layers. This may involve heat treatment, e.g., by one or more co-firing steps. The protrusion 120 may be formed by preparing one or more of the ceramic-based layers with a larger horizontal dimension, so that they extend beyond the other ceramic-based layers. Further, the protrusion 120 may be formed by removing a part of some of the ceramic-based layers after connecting the ceramic-based layers, e.g., by mechanical and/or chemical processing, such as milling, grinding, or etching.

As further illustrated, an antenna 140 is provided on the protrusion 120 of the multi-layer ceramic-based structure 110. The antenna 140 is formed by conductive structures on the ceramic-based layer(s) forming the protrusion. In FIG. 1, conductive structures of the antenna 140 on the top side of the topmost ceramic-based layer are visible. However, as will be further explained below, the antenna 140 may also include further conductive structures, e.g., on the bottom side of the protrusion 120.

Figure 2:
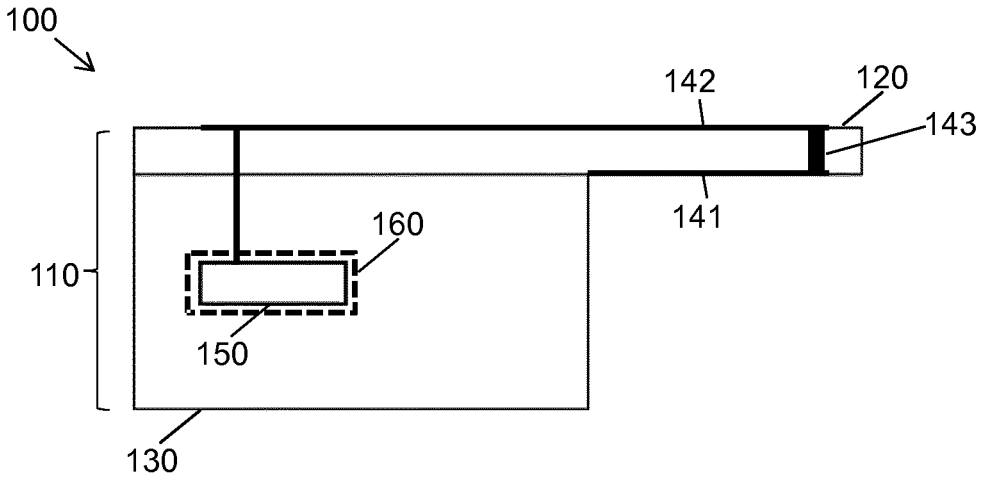
FIG. 2 shows a schematic sectional view of the antenna device.

FIG. 2 shows a schematic sectional view of the antenna device 100. As can be seen, in the illustrated example the antenna 140 is formed of a first conductive layer 141 on the bottom side of the protrusion 120 and a second conductive layer 142 on the top side of the protrusion 120. The conductive layer 141 on the bottom side of the protrusion 120 forms one or more antenna patches. The conductive layer 142 on the top side of the protrusion 120 forms a feeding patch for feeding the antenna patch(es). As further illustrated, the conductive layer 142 on the top side of the protrusion 120 also provides an electrical connection of the antenna 140 towards the main body portion 130, in particular to a radio front and circuitry chip 150 housed in a cavity 160 of the main body portion 130.

The feeding of the antenna patch(es) may be capacitive. In addition or as an alternative, also conductive feeding may be used. For this purpose, a conductive via 143 may be provided between the first conductive layer 141 and the second conductive layer 142. As illustrated, the conductive via 143 extends through the ceramic-based layers forming the protrusion 120.

Figure 3:
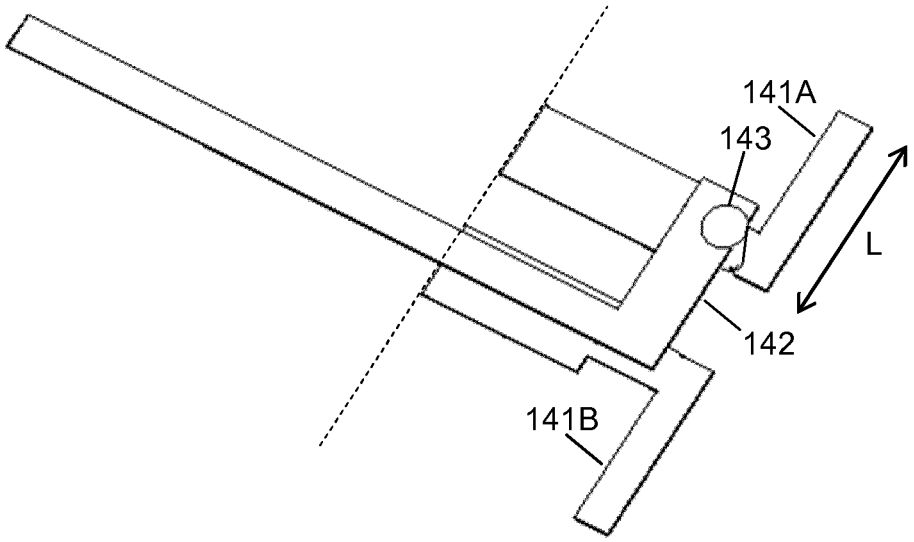
FIG. 3 shows a perspective view for illustrating a dipole antenna configuration which may be used in the antenna device.

FIG. 3 shows a perspective view for illustrating an example of an antenna configuration which may be used for the antenna 140. FIG. 3 focuses on the conductive structures forming the antenna 140, and illustration of the ceramic-based layers of the multi-layer ceramic-based structure 110 was omitted for the sake of a better overview. The edge of the main body portion 130 of the multi-layer ceramic-based structure 110 is schematically illustrated by a dashed line.

In the example of FIG. 3, the antenna 140 is configured as a dipole antenna with a first antenna patch 141A and a second antenna patch 141B formed in the first conductive layer 141. The feeding of the dipole antenna is accomplished conductively by the conductive via 143 extending from the feeding patch formed in the conductive layer 141 to the antenna patch 141A. The second antenna patch 141B is capacitively coupled to the first antenna patch 141A and to the feeding patch. Accordingly, the feeding of the dipole antenna is in part also accomplished capacitively.

In the antenna configuration of FIG. 3, the thickness of the ceramic-based layer(s) forming the protrusion 120 may be 0.2 to 0.5 mm. This thickness also and defines the distance between the first conductive layer 141 and the second conductive layer 142. The length L of the antenna patches 141A, 141B, defining the effective dimension of the antenna 140, may be 3 mm. The dielectric constant of the ceramic-based layer(s) forming the protrusion 120 may be 5 to 8.

Figure 4:
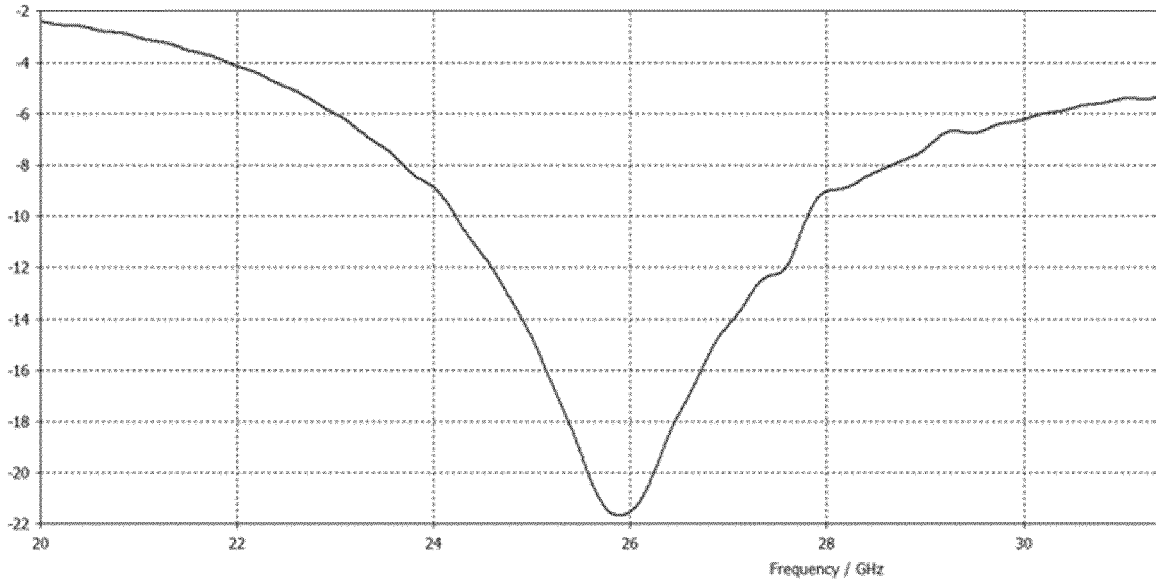
FIGS. 4 and 5 show diagrams for illustrating transmission characteristics of an antenna according to an embodiment of the invention.
Figure 5:
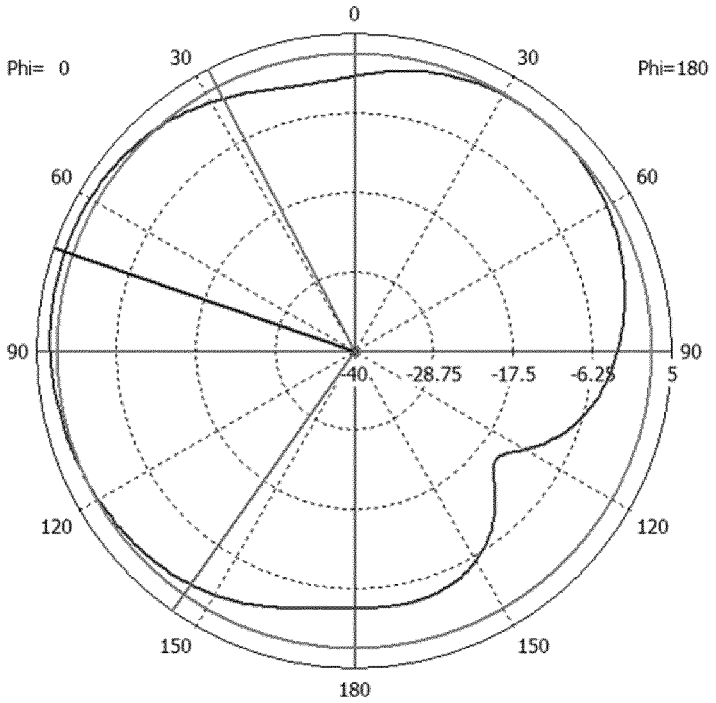

FIGS. 4 and 5 show exemplary simulation results obtained for an antenna configuration as illustrated in FIG. 3. Specifically, FIG. 4 shows the dependency of the antenna gain (in dB) on the frequency, while FIG. 5 shows the angular dependency of farfield realized gain. As can be seen, the antenna configuration allows for achieving a high usable bandwidth of about 1 to 2 GHz, centered around 26 GHz. Further, the antenna configuration allows for achieving a omnidirectional transmission characteristic.

Figure 6:
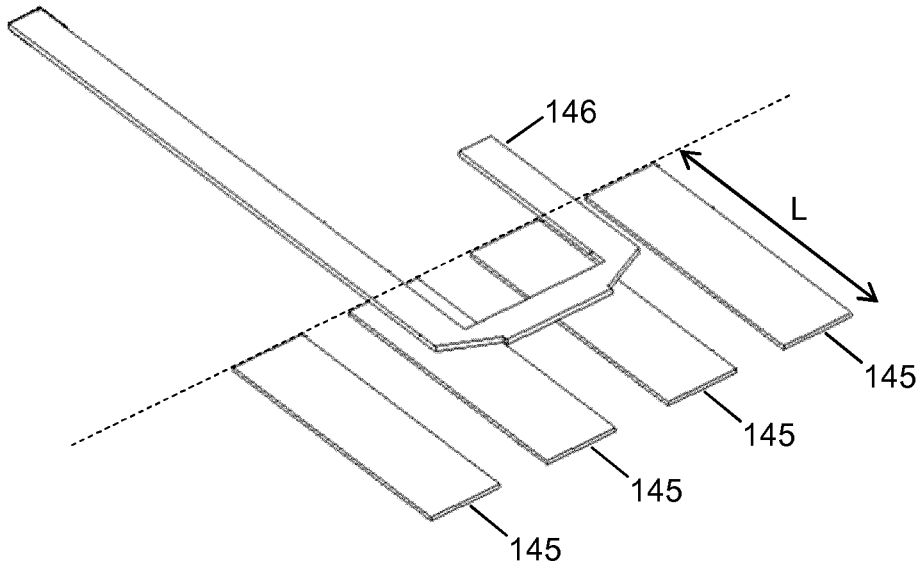
FIG. 6 shows a perspective view for illustrating a notch antenna configuration which may be used in the antenna device.

FIG. 6 shows a perspective view for illustrating a further example of an antenna configuration which may be used for the antenna 140. FIG. 6 focuses on the conductive structures forming the antenna 140, and illustration of the ceramic-based layers of the multi-layer ceramic-based structure 110 was omitted for the sake of a better overview. The edge of the main body portion 130 of the multi-layer ceramic-based structure 110 is schematically illustrated by a dashed line.

In the example of FIG. 6, the antenna 140 is configured as a notch antenna with multiple notch like antenna patches 145 formed in the first conductive layer 141. The feeding of the notch antenna is accomplished capacitively by a feeding patch 145 formed in the conductive layer 141. As can be seen, the feeding patch 145 extends in a U-like shape on the top side of the protrusion 120.

In the antenna configuration of FIG. 6, the thickness of the ceramic-based layer(s) forming the protrusion 120 may be 0.2 to 0.5 mm. This thickness also and defines the distance between the first conductive layer 141 and the second conductive layer 142. The length L of the notch like antenna patches 145, defining the effective dimension of the antenna 140, may be 3 mm. The dielectric constant of the ceramic-based layer(s) forming the protrusion 120 may be 5 to 8. Simulations have shown that the antenna configuration of FIG. 6 allows for achieving a similar bandwidth and omnidirectional transmission characteristic as the case of the antenna configuration of FIG. 3.

It is noted that in the examples of FIGS. 1, 2, 3, and 6 the illustrated arrangement of the feeding patch(es) being provided in the conductive layer 142 and the antenna patch(es) being provided in the conductive layer 141, e.g., below the feeding patch(es), is only one option, and other arrangements could be used as well. For example, the feeding patch(es) could be provided in the conductive layer 141 and the antenna patch(es) provided in the conductive layer 142. Further, one or more additional conductive layers could be provided, e.g., a topmost conductive layer for providing electrical shielding.

Figure 7A:
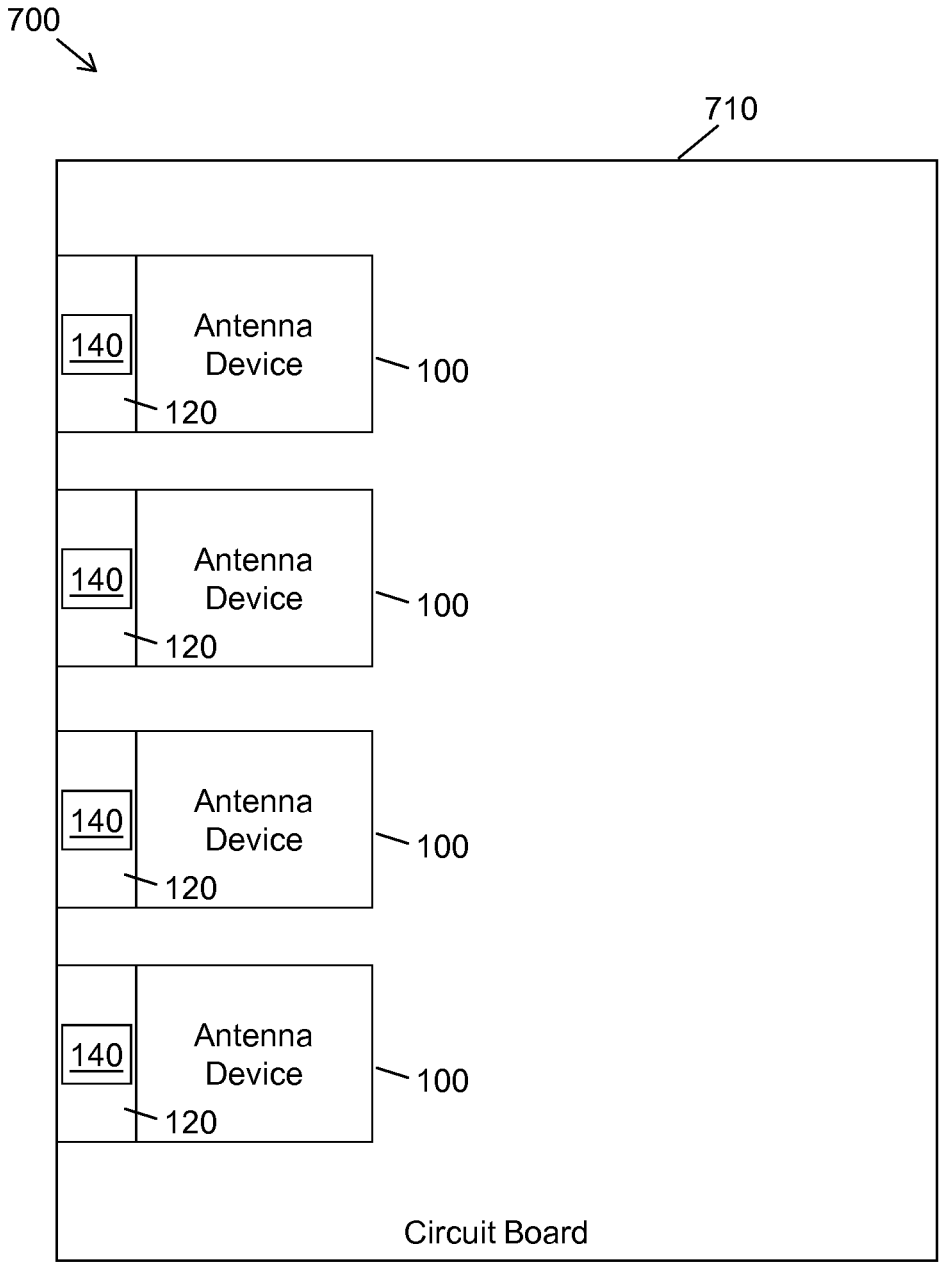
FIG. 7A schematically illustrates an assembly in which multiple antenna devices according to an embodiment of the invention are arranged on a circuit board.

FIG. 7A schematically illustrates an assembly including a circuit board 710, e.g., a PCB, and multiple antenna devices 100 arranged on the circuit board 710. The antenna devices 100 may each have a configuration as explained in connection with FIGS. 1 to 6. As illustrated, the antenna devices 100 are arranged along an outer edge of the circuit board 710. Specifically, the protrusions 120 of the antenna devices 100 are aligned with the outer edge of the circuit board 710. The protrusions 120 may be flush with the outer edge of the circuit board 710 or may even extend beyond the outer edge of the circuit board 710. In this way, the antennas 140 of the antenna devices 100 may be placed close to an outer edge, e.g., housing, of an apparatus in which the assembly 700 is used. This allows for achieving favorable transmission characteristics, in particular in the millimeter wavelength range, corresponding to frequencies in the range of about 10 GHz to about 100 GHz. Distortion or attenuation of transmitted signals by the circuit board 710 components arranged on one close to the circuit board can thus be avoided. The antennas 140 of the antenna devices 100 may for example configured to co-operate as an antenna array or subarray of an antenna array. It is noted that also other components may be arranged on the circuit board 710. Such components may for example include one or more processors for generating all processing signals transmitted by the antennas 140 of the antenna devices 100.

Figure 7B:
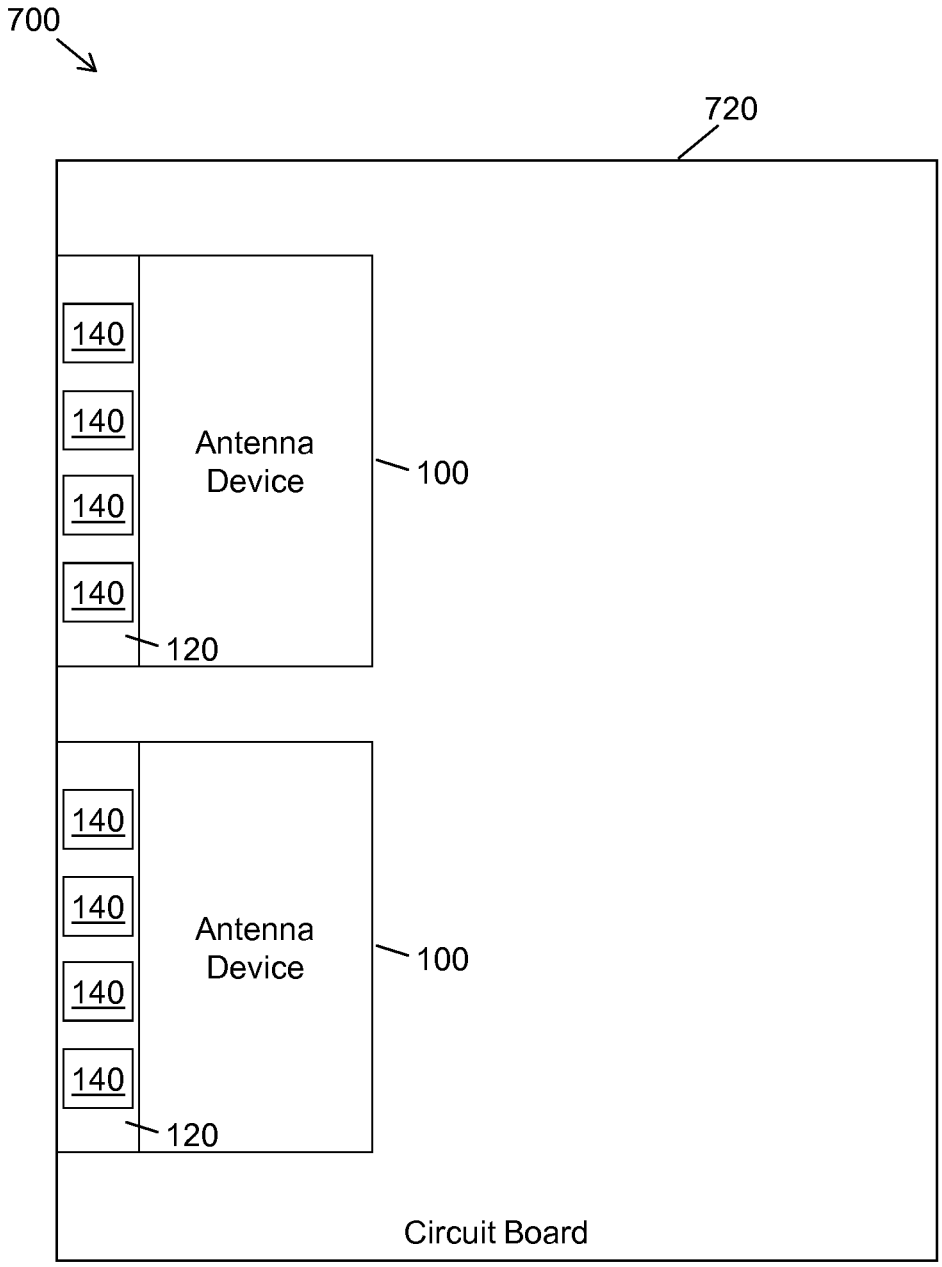
FIG. 7B schematically illustrates a further assembly in which multiple antenna devices according to an embodiment of the invention are arranged on a circuit board.

In the example, of FIG. 7A, the antenna devices 100 are each illustrated as being provided with one antenna on the protrusion 120. However, it is also possible to provide multiple antennas 140 on the protrusion 120 of the same antenna device 100. A corresponding example is illustrated in FIG. 7B. In the example of FIG. 7B, multiple antenna devices 100 are arranged on a circuit board 720, e.g., a PCB. Each antenna device 100 has the protrusion 120, which is aligned with the outer edge of the circuit board 720. Again, the protrusions 120 may be flush with the outer edge of the circuit board 720 or may even extend beyond the outer edge of the circuit board 720. As illustrated, each protrusion 120 provides multiple antennas 140. The multiple antennas 140 of the same antenna device 100 may for example configured to co-operate as an antenna array or subarray of an antenna array. For example, all antennas 140 illustrated in FIG. 7B could co-operate as an antenna array, and the antennas 140 of the same antenna device 100 could co-operate as a subarray of this antenna array. Also in the example of FIG. 7B, also other components could be arranged on the circuit board 720. Such components may for example include one or more processors for generating all processing signals transmitted by the antennas 140 of the antenna devices 100.

Figure 8:
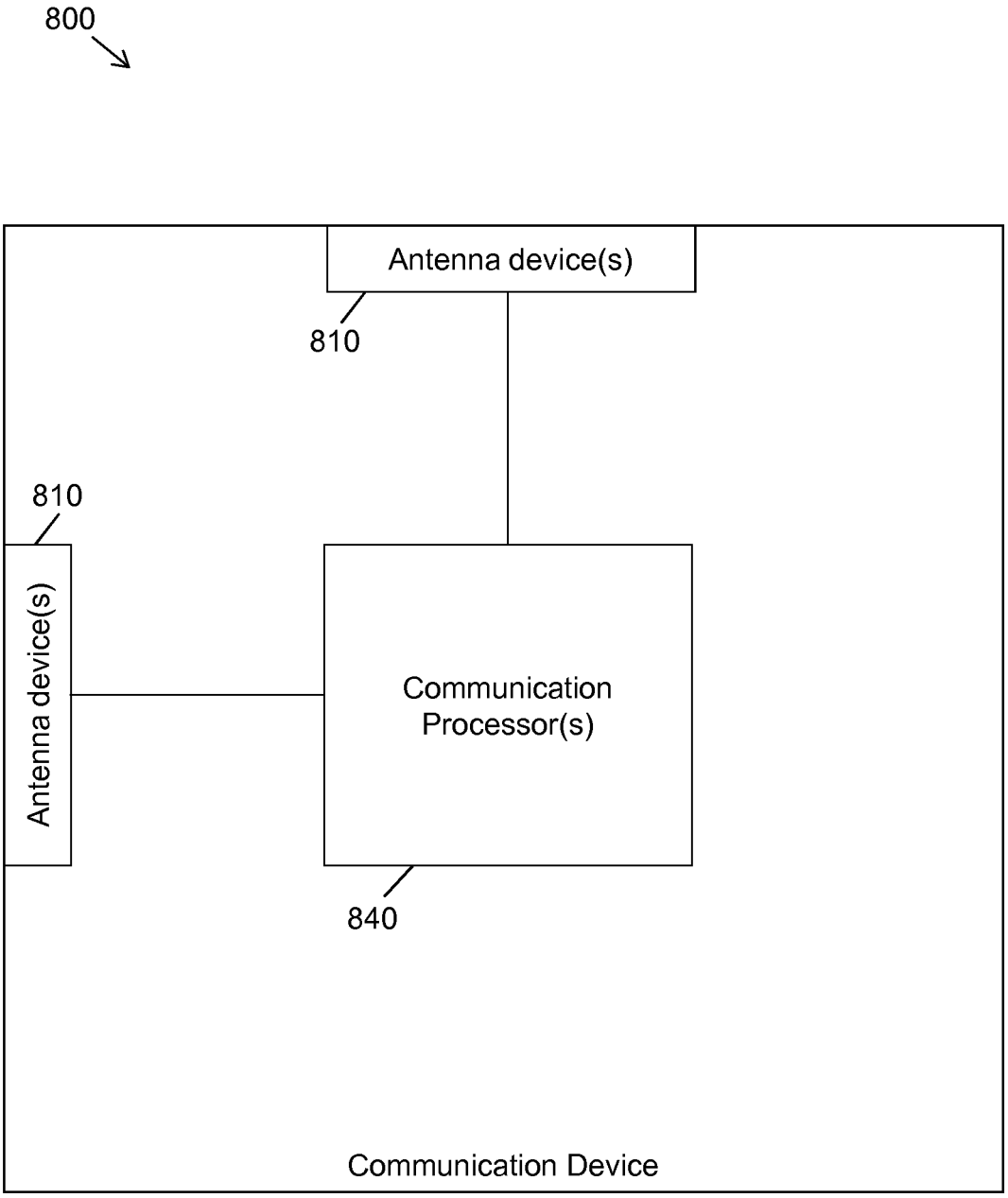
FIG. 8 shows a block diagram for schematically illustrating a communication device according to an embodiment of the invention.

FIG. 8 shows a block diagram for schematically illustrating a communication device 800 which is equipped with one or more antenna devices as explained above, e.g., with the antenna device 100. The communication device 800 may correspond to a small sized user device, e.g., a mobile phone, a smartphone, a tablet computer, or the like. However, it is to be understood that other kinds of communication devices could be used as well, e.g., vehicle based communication devices, wireless modems, or autonomous sensors.

As illustrated, the communication device 800 includes one or more antenna devices 810. At least some of these antenna devices 810 may correspond to an antenna device as explained above, e.g., an antenna device including an antenna formed on a protrusion of a multi-layer ceramic-based structure, such as the above-mentioned antenna 140 which is formed on the protrusion 120. Further, the communication device 800 may also include other kinds of antennas or antenna devices. Using concepts as explained above, the antennas may be integrated together with radio front end circuitry. Specifically, at least a part of the radio front end circuitry may be integrated with the antenna 140 formed on the protrusion by embedding it in the multi-layer ceramic-based structure. Further, the communication device 800 includes one or more communication processor(s) 840. The communication processor(s) 840 may generate or otherwise process communication signals for transmission via the antennas of the antenna devices 810. For this purpose, the communication processor(s) 840 may perform various kinds of signal processing and data processing according to one or more communication protocols, e.g., in accordance with a 5G cellular radio technology. The communication device 800 may include an assembly as illustrated in FIG. 7A or 7B. In this case, at least some of the antennas devices 810 could be located on the circuit board 710 or 720. Further, also the communication processor(s) 840 could be located on the circuit board 710 or 720.

It is to be understood that the concepts as explained above are susceptible to various modifications. For example, the concepts could be applied in connection with various kinds of radio technologies and communication devices, without limitation to a 5G technology. The illustrated antennas may be used for transmitting radio signals from a communication device and/or for receiving radio signals in a communication device. Further, it is to be understood that the illustrated antenna structures may be based on various types of antenna configurations, without limitation to dipole antennas or notch antennas, e.g., an IFA configuration, a vertical edge patch antenna configuration, and/or an SIW antenna configuration and be subjected to various modifications concerning antenna geometry. Further, the illustrated antenna devices are not limited to be equipped with a single antenna located on a single protrusion. Rather, it is also conceivable to provide multiple antennas on one protrusion of the multi-layer ceramic-based structure, e.g., to provide an antenna array or subarray of an antenna array on the protrusion, or to provide the multi-layer ceramic-based structure with multiple protrusions, e.g., at different edges, each protrusion carrying one or more antennas. In the latter case, the multiple antennas on the different protrusions of the multi-layer ceramic-based structure could be configured to co-operate as an antenna array or subarray of an antenna array.

The invention claimed is:

1. A device, comprising:

a multi-layer ceramic-based structure comprising a plurality of ceramic-based layers;

a protrusion formed by at least one of the ceramic-based layers extending beyond at least one other of the ceramic-based layers at an edge of the multi-layer ceramic-based structure; and at least one antenna entirely formed by at least one conductive layer on the protrusion.

2. The device according to claim 1, wherein the at least one antenna is formed by a first conductive layer on one side of the protrusion and a second conductive layer separated by at least one of the ceramic-based layers forming the protrusion.

3. The device according to claim 2, wherein the first conductive layer and the second conductive layer are connected by a conductive via extending through the at least one ceramic-based layer forming the protrusion.

4. The device according to claim 2, wherein the first conductive layer comprises an at least one antenna patch and the second conductive layer comprises at least one feeding patch configured for feeding the at least one antenna patch.

5. The device according to claim 4, wherein the at least one feeding patch is configured for conductively feeding at least one of the antenna patches.

6. The device according to claim 4, wherein the at least one feeding patch is configured for capacitively feeding at least one of the antenna patches.

7. The device according to claim 1, wherein the at least one antenna comprises a dipole antenna.

8. The device according to claim 1, wherein the at least one antenna comprises a notch antenna.

9. The device according to claim 1, further comprising:

radio front end circuitry housed in a cavity of the multi-layer ceramic-based structure.

10. The device according to claim 1, wherein the antenna is configured for transmission of radio signals having a wavelength of more than 1 mm and less than 3 cm.

11. The device according to claim 1, wherein the multi-layer ceramic-based structure is a low temperature co-fired ceramic-based structure.

12. An assembly, comprising:

at least one device according to claim 1; and a circuit board on which the at least one device is arranged.

13. The assembly according to claim 12, wherein the at least one device is arranged with the at least one antenna located at an edge of the circuit board.

14. A communication device, comprising:

at least one device according to claim 1; and at least one processor configured to process communication signals transmitted via the at least one antenna of the at least one device.

* * * * *